United States Patent [19]

Shimaguchi et al.

[11] Patent Number: 4,659,526

[45] Date of Patent: Apr. 21, 1987

[54] SLIP CASTING FORMING METHOD AND MOLD

[75] Inventors: Takashi Shimaguchi, Ibaraki; Tatsuo Natori, Kashiwa; Akihide Watanabe, Ibaraki; Keiichi Koike, Matsudo, all of Japan

[73] Assignee: Hitachi, Ltd., Tokyo, Japan

[21] Appl. No.: 719,073

[22] Filed: Apr. 2, 1985

[30] Foreign Application Priority Data

Apr. 2, 1984 [JP] Japan ..... 59-63319
Nov. 9, 1984 [JP] Japan ..... 59-234979

[51] Int. Cl.[4] ..... B28B 1/26

[52] U.S. Cl. ..... 264/86; 264/317; 419/40; 419/66

[58] Field of Search ..... 264/86, 317; 419/40, 419/66

[56] References Cited

U.S. PATENT DOCUMENTS 3,997,640 12/1976 Walton ..... 264/86

FOREIGN PATENT DOCUMENTS 1482436 8/1977 United Kingdom .

OTHER PUBLICATIONS

Votava et al, Microstructures and Properties of Permeable Mold Materials, Ceramic Bulletin, vol. 58, No. 2 (1979) pp. 144–196 & 200.

*Primary Examiner*—James Derrington
*Attorney, Agent, or Firm*—Antonelli, Terry & Wands

[57] ABSTRACT

In a forming method and a mold wherein a slip is cast into the mold and wherein the mold is removed after hardening of the slip, the mold is patterned by the use of a water-soluble binder. The mold absorbs a water content in the slip to soften and to become easy of removal, while the slip has the water content absorbed to harden promptly. Therefore, the forming method and the mold are especially suited to produce a cast article of complicated shape.

13 Claims, 3 Drawing Figures

SLIP CASTING FORMING METHOD AND MOLD

BACKGROUND OF THE INVENTION

1. Field of the Invention

The present invention relates to a slip casting forming method and mold in and with which the slip of refractory powders, for example, ceramic powders, metallic powders or carbon powders is cast to produce a cast article (green body), and more particularly to a forming method and mold which are well suited to produce a cast article of complicated shape.

2. Description of the Prior Art

In case of forming, by slip casting, a hollow molding whose cavity portion has a complicated shape, that is, a molding which requires a core of complicated shape not extractible due to an inverse gradient, the removal of the core has been difficult or impossible with a conventional gypsum mold.

A prior art method pertinent to the present invention is disclosed in British Pat. No. 1482436. This method consists in that a mold is made of an organic material soluble in a solvent for a part of complicated shape, while a gypsum mold is used for a part of simple shape, and that both the molds are assembled into a desired mold. This method, however, does not take it into consideration that depending upon the geometries of a cast article, a green body (a cast article) involves a difference in density between the organic part and the gypsum part, to affect the reliability of the strength of the sintering body or to affect the dimensional accuracy of the sintering body or the job efficiency of the fabrication thereof.

OBJECT OF THE INVENTION

In view of the above, the present invention has for its object to provide a slip casting mold with which a core or a mold is readily removed even in a case where a cast article of complicated shape, namely, a cast article requiring the core or the mold of complicated shape, is formed by slip casting.

SUMMARY OF THE INVENTION

The present invention consists in a forming method in which a slip containing water is cast into a mold and the mold is removed after the hardening of the slip, characterized in that the mold is made by the use of a water-soluble binder.

The present invention consists in a mold into which a slip containing water is cast and which is removed after the hardening of the slip, characterized by being made by the use of a binder soluble in water at room temperature.

The bone material of a mold to be used is powders insoluble or hardly soluble in the water of the slip, for example, the powders of alumina ($Al_2O_3$), magnesia (MgZO), zircon sand, or silica sand. The water-soluble binder to be used is a carbonate such as sodium carbonate ($Na_2CO_3$) or potassium carbonate ($K_2CO_3O$; a chloride such as sodium chloride (NaCl), potassium chloride (KCl), magnesium chloride ($MgCl_2$) or lithium chloride (LiCl); a phosphate such as trisodium phosphate ($Na_3PO_4$), tripotassium phosphate ($K_3PO_4$) or dipotassium hydrogen phosphate ($K_2HPO_4$); or a sulfate such as sodium hydrogen sulfate ($NaHSO_4$), potassium hydrogen sulfate ($KHSO_4$), ammonium sulfate ($(NH_4)_2SO_4$), magnesium sulfate ($MgSO_4$), sodium sulfate ($Na_2SO_4$), potassium sulfate ($K_2SO_4$), lithium sulfate ($LiSO_4$) or aluminum sulfate ($Al_2(SO_4)_3$).

The mixing ratio of the bone material of a mold, the binder and water should preferably be set at the bone material of a mold: 50–95 weight-% and the binder and water: 5–50 weight-% from the aspects of the strength and economy of the mold.

With increase in the quantity of addition of the binder, the mold strength is stabilized more, and the stability of a mold surface is enhanced more, so that the handling of the mold is facilitated more. However, an unnecessarily high strength is not desired in the present invention which is intended to lower the mold strength owing to the absorption of water from the slip. When the binder is added in excess, the roughness of the surface of the mold is noted at a drying step, and hence, a quantity of addition exceeding 47 weight-% is unfavorable. On the other hand, the binder in an amount less than 2 weight-% is not practical because of an insufficient mold strength.

Meanwhile, the quantity of addition of the water contents affects the job efficiency of the mold fabricating operation and the stability of the mold surface. Especially when the water content is less than 3 weight-% with respect to the total weight including the bone material of a mold, the fabrication of the mold becomes difficult.

Accordingly, the aforementioned value of 5–50 weight-% based on the total weight is proper for the sum of the binder and the water.

Besides, while a thin-walled mold can be broken down by only the water content of the slip, a thick-walled mold for which a water content necessary for breakdown cannot be obtained should preferably have its wall thinned. To this end, a thick-walled core may be provided with a cavity therein.

In the present invention, the slip containing water is cast into the mold prepared by binding the powders with the water-soluble binder. The resulting phenomenon in which the mold absorbs the water content of the slip to harden the slip and to simultaneously become easy to breakdown, and the reason why a cast article of complicated shape can be formed are as stated below.

As shown in FIGS. 1(*a*), 1(*b*) and 1(*c*), bone powder of a mold 1 is covered with a water-soluble binder 2 in an undried condition (refer to FIG. 1(*a*)); in a dried and cured mold, a water content has vaporized to form micro pores 3 in the interior of the mold (refer to FIG. 1(*b*)); and when a slip is cast into such mold, a water content (also including other liquids) in the slip permeates the pores 3 to reduce the bindability of the water-soluble binder 2 and to render the respective powders 1 independent (refer to FIG. 1(*c*)). As a result, a mold of low strength which is easily removed is produced, while the slip releases the water content to produce a green body. Even in a case where the mold is complicated on account of a complicated article or where a core is used, the water content necessary for breakdown is absorbed from the slip equally at various parts including a deep part, so that the various parts can break down uniformly.

As the mold absorbs the water content of the slip, it turns into the mold capable of breakdown from the boundary surface at which the mold and the slip lie in contact. Meanwhile, as the slip releases the water content, it increases the amounts of contraction and deformation thereof until the green body is produced. Herein, in the present invention, the mold surface (bordering the slip) softens with the absorption of the water content, and hence, contraction and deformation arising in the process of producing the green body are not hampered. This makes it possible to obtain the green body in which the occurrence of cracks is not observed. Moreover, since the mold has had its strength lowered by the absorption of water, the removal thereof is very easy, and especially the green body having a complicated shape or a shape requiring a core may to be formed.

The preparation of the mold is performed by tamping the admixture which consists of the bone powder of a mold, the water-soluble binder and water. The preparation time can be shortened by affording fluidity to the mold material. The fluidity may be afforded in such a way that an alcohol solution of the water-soluble binder which is stable in the form of a hydrate at the room temperature is prepared, and that water in an amount necessary for fixation or in a smaller amount is added thereto as water of crystallization.

DETAILED DESCRIPTION OF THE INVENTION

Now, examples of the present invention will be explained.

[EXAMPLE 1]

Figure 1:
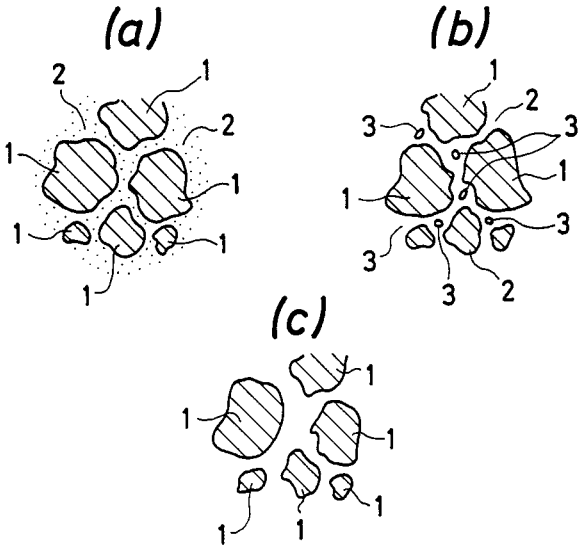
FIGS. 1(*a*), 1(*b*) and 1(*c*) are diagrams for explaining the water absorptivity of a mold according to the present invention.
Figure 2:
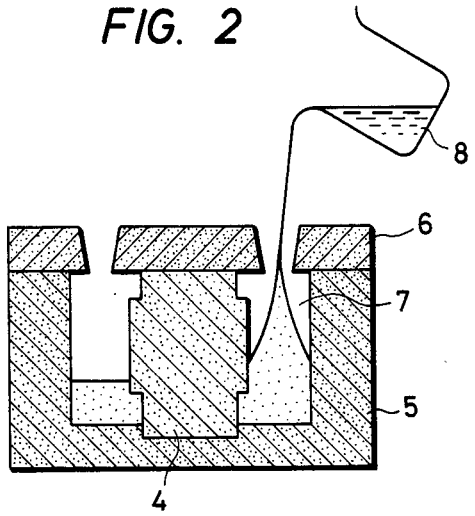
FIG. 2 is a view for explaining an embodiment of a forming method according to the present invention.

100 weight-parts of zircon, 20 weight-parts of $K_2PO_4$ and 8 weight-parts of water were kneaded to prepare a mold material, which was patterned by the use of a wooden pattern and was thereafter dried at 200° C. to make a core. The core was assembled as shown in FIG. 2. That is, the core 4 was assembled together with another mold of gypsum (split in two) 5 and a lid 6. A slip (prepared by kneading 100 weight-parts of $Al_2O_3$ and 16 weight-parts of water) 8 was cast into a cavity portion 7, and was let stand for one hour. After the hardening of the slip, the mold 5 and the lid 6 were taken off. Since the core 4 had absorbed a water content in the slip, it could be readily removed owing to a reduced bindability. The occurrence of cracks was not observed in a green body.

[EXAMPLE 2 ]

100 weight-parts of $Al_2O_3$ (250–325 meshes), 10 weight-parts of $K_2CO_3$ and 12 weight-parts of water were kneaded to prepare a mold material, which was patterned by the use of a wooden pattern and was thereafter dried at 200° C. to make a core, which was assembled similarly to that in Example 1. An $Al_2O_3$ slip (the same as in Example 1) was cast into the assembly, and was let stand for one hour. The core 4 could be readily removed, and the occurrence of cracks was not observed.

[EXAMPLE 3]

30 weight-parts of MgO (0.1–0.3 mm in diameter), 70 weight-parts of $Al_2O_3$ (250–320 meshes), 32 weight-parts of $Na_2CO_3$ and 10 weight-parts of water were kneaded to prepare a mold material, which was patterned by the use of a wooden pattern and was thereafter dried at 200° C. to form a core, which was assembled as in Example 1. An $Al_2O_3$ slip (the same as in Example 1) was cast into the mold assembly, and was let stand for one hour. The core 4 could be readily removed, and the occurrence of cracks was not noted.

[EXAMPLE 4]

Figure 3:
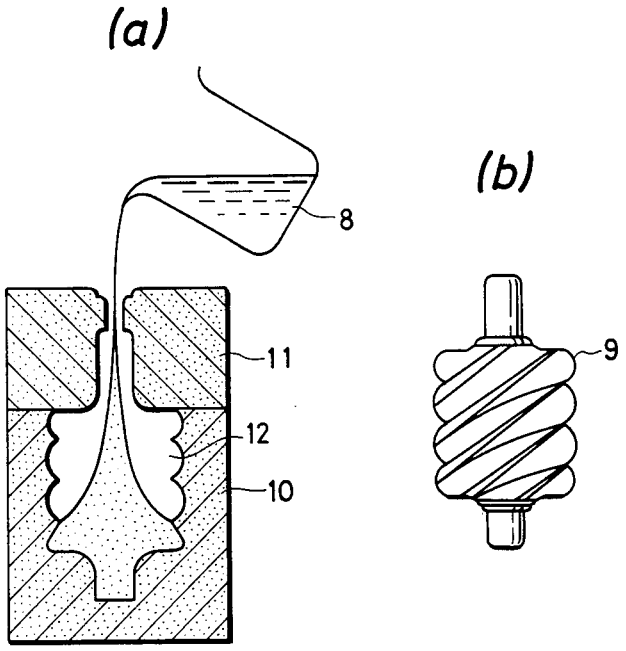
FIGS. 3(*a*) and 3(*b*) are views for explaining another embodiment of the forming method according to the present invention.

Referring to FIGS. 3(*a*) and 3(*b*), a model of the same shape as that of an article 9 shown in FIG. 3(*b*) was made, and the model and a flask were used to make molds 10 and 11 split in two, which were assembled as shown in FIG. 3(*a*). The mold 10 was a mold which was fabricated from a slurry prepared by kneading 90 weight-parts of $Al_2O_3$, 8 weight-parts of $Na_2CO_3$, 28 weight-parts of ethyl alcohol and 5 weight-parts of water, while the mold 11 was a gypsum mold. An $Al_2O_3$ slip (the same as in Example 1) was cast into a cavity portion 12, and was let stand for one hour. After the hardening of the slip, the mold 11 was taken off and the mold 10 was removed. Since the mold 10 had absorbed the water content of the slip, the removal was easy. No crack was noted in the surface of a green body.

[EXAMPLE 5]

100 weight-parts of $Al_2O_3$ (250–325 meshes), 7 weight-parts of $MgSO_4$ and 15 weight-parts of water were kneaded to prepare a mold material, which was patterned by the use of a wooden pattern and was thereafter dried at 200° C. to form a core, which was assembled as shown in FIG. 2. That is, the core 4 was assembled together with another mold of gypsum (split in two) 5 and a lid 6. A slip (prepared by kneading 100 weight-parts of $Al_2O_3$ and 16 weight-parts of water) 8 was cast into a cavity portion 7, and was let stand for one hour. After the hardening of the slip, the mold 5 and the lid 6 were taken off. Since the core 4 had absorbed the water content of the slip, it could be readily removed owing to a reduced bindability. The occurrence of cracks was not noted in a green body.

[EXAMPLE 6]

100 weight-parts of alumina (mesh No. 120), 6 weight-parts of sodium hydrogen sulfate ($NaHSO_4$) and 14 weight-parts of water were kneaded to prepare a mold material, which was patterned by the use of a wooden pattern and was thereafter dried at 200° C. to form a core. The core was assembled as shown in FIG. 2. That is, the core 4 was assembled together with another mold of gypsum (split in two) 5 and a lid 6. A slip (prepared by kneading 100 weight-parts of $Al_2O_3$ and 16 weight-parts of water) 8 was cast into a cavity portion 7, and was let stand for one hour. After the hardening of the slip, the mold 5 and the lid 6 were taken off. Since the core 4 had absorbed the water content of the slip, it could be readily removed owing to a reduced bindability. The occurrence of cracks was not noted in a green body.

As described above, according to the present invention, a mold is made by the use of a water-soluble binder, whereby the mold absorbs water necessary for breakdown from a slip and softens to become easy of the breakdown, while the contraction and deformation of a green body produced by the release of the water content are absorbed by the mold having softened, so that the occurrence of cracks can be prevented in the process of producing the green body and that the casting of an article having a complicated shape or a shape requiring a core becomes possible.

We claim:

1. In a forming method wherein a slip containing water is cast into a mold, and the mold is removed after hardening of the slip; a slip casting forming method characterized in that powders insoluble in the water of said slip are used as a bone material of said mold and are patterned by using as a water-soluble binder, a material selected from the group consisting of a carbonate, a chloride, a phosphate and a sulfate.

2. A slip casting forming method as defined in claim 1, wherein the bone material of the mold is the powders of at least one member selected from the group consisting of alumina, magnesia, zircon sand and silica sand.

3. A slip casting forming method as defined in claim 1, wherein said binder is a carbonate.

4. A slip casting forming method as defined in claim 3, wherein said carbonate is one member selected from the group consisting of sodium carbonate and potassium carbonate.

5. A slip casting forming method as defined in claim 1, wherein said binder is a chloride.

6. A slip casting forming method as defined in claim 5, wherein said chloride is one member selected from the group consisting of sodium chloride, potassium chloride, magnesium chloride and lithium chloride.

7. A slip casting forming method as defined in claim 1, wherein said binder is a phosphate.

8. A slip casting forming method as defined in claim 7, wherein said phosphate is one member selected from the group consisting of trisodium phosphate, tripotassium phosphate and dipotassium hydrogen phosphate.

9. A slip casting forming method as defined in claim 1, wherein said binder is a sulfate.

10. A slip casting forming method as defined in claim 9, wherein said sulfate is one member selected from the group consisting of sodium hydrogen sulfate, potassium hydrogen sulfate, ammonium hydrogen sulfate, magnesium sulfate, sodium sulfate, potassium sulfate, lithium sulfate and aluminum sulfate.

11. A slip casting forming method as defined in any one of claims 3, 5, 7 and 9, wherein alcohol is added to said binder.

12. A slip casting forming method as defined in claim 1, wherein said mold is provided with a cavity.

13. A slip casting forming method as defined in claim 1, wherein said bone material of the mold is of 50–95 weight-%, and said binder and water are of 5–50 weight-%.

* * * * *